US005259258A

United States Patent [19]

Sebor

[11] Patent Number: 5,259,258

[45] Date of Patent: Nov. 9, 1993

[54] FRICTION CLUTCH DRIVE FOR A SUBMERSIBLE CLEANING DEVICE

[76] Inventor: Pavel Sebor, 45 Highcliff Way, Northcliff Extension 12, Johannesburg, Transvall, South Africa

[21] Appl. No.: 880,663

[22] Filed: May 11, 1992

[30] Foreign Application Priority Data

Feb. 28, 1992 [ZA] South Africa ..... 92/1506

[51] Int. Cl.[5] ..... F16H 29/12

[52] U.S. Cl. ..... 74/126; 192/12 B

[58] Field of Search ..... 74/126, 142; 192/12 B

[56] References Cited

U.S. PATENT DOCUMENTS 1,719,613 7/1929 Kohler ..... 74/126 X 1,985,406 12/1934 Galkin ..... 192/12 B 3,433,093 3/1969 Marti ..... 74/142 X

FOREIGN PATENT DOCUMENTS 1234473 2/1967 Fed. Rep. of Germany ..... 74/142

*Primary Examiner*—Allan D. Herrmann

*Attorney, Agent, or Firm*—Allen, Dyer, Doppelt, Franjola & Milbrath

[57] ABSTRACT

A friction clutch drive is used to translate the oscillating angular movement of the oscillator in a submersible pool cleaner into a unidirectional periodic angular movement. A disc element affixed to a drive shaft of the oscillator is urged into contact with a second friction surface using a compression spring. The second disc is secured to a drum formation to which a gear to be driven is integrally formed so that rotational movement of the second disc causes rotational movement of the gear. To limit movement of the driven gear to one direction, a ratchet gear is affixed to the periphery of the drum and which engages a pawl to permit the single directional rotation of the drum and thus the driven gear.

2 Claims, 1 Drawing Sheet

FRICTION CLUTCH DRIVE FOR A SUBMERSIBLE CLEANING DEVICE

FIELD OF THE INVENTION

This invention relates to means for translating reciprocating movement of a drive mechanism to rotational movement of drive means such as a gear, shaft or the like particularly suitable for use with a submersible cleaning device.

SUMMARY OF THE INVENTION

It is thus an object of the present invention to provide means whereby oscillating angular movement may be translated into one direction periodic angular movement through frictional action. The term "shaft" herein includes a gear wheel, lever, or the like.

According to the invention such means comprises a first friction surface associated with the oscillating drive shaft and a second friction surface associated with a driven shaft, the first and second friction surfaces being urged into frictional engagement with one another by biasing means; such that angular movement of the drive shaft in one direction causes corresponding angular movement of the driven shaft as a result of the frictional engagement of the friction surfaces, and optionally a pawl and ratchet arrangement associated with the driven shaft such that angular movement of the drive shaft in the reverse direction causes the friction surfaces to slip as the pawl and ratchet arrangement acts to prevent reverse movement of the driven shaft.

In a preferred arrangement according to the invention the driven shaft will define a drum formation within which the first and second friction surfaces are housed. With such an arrangement ratchet teeth for the pawl and ratchet arrangement could conveniently be defined on the outer peripheral surface of the socket formation. With such an arrangement also the socket formation could be closed with a friction surface being defined at one interior extremity of the socket formation, with a friction disc being biased into frictional contact with such surface, the drive shaft being secured either to the drum or to a friction disc and vice versa in respect of the driven shaft. Preferably the friction disc will be biased into contact with the second friction surface by means of a compression, spring or the like.

BRIEF DESCRIPTION OF DRAWINGS

In order to more clearly illustrate the invention, an embodiment thereof is described hereunder purely by way of example with reference to the accompanying drawings wherein.

DETAILED DESCRIPTION OF PREFERRED EMBODIMENT

Figure 1:
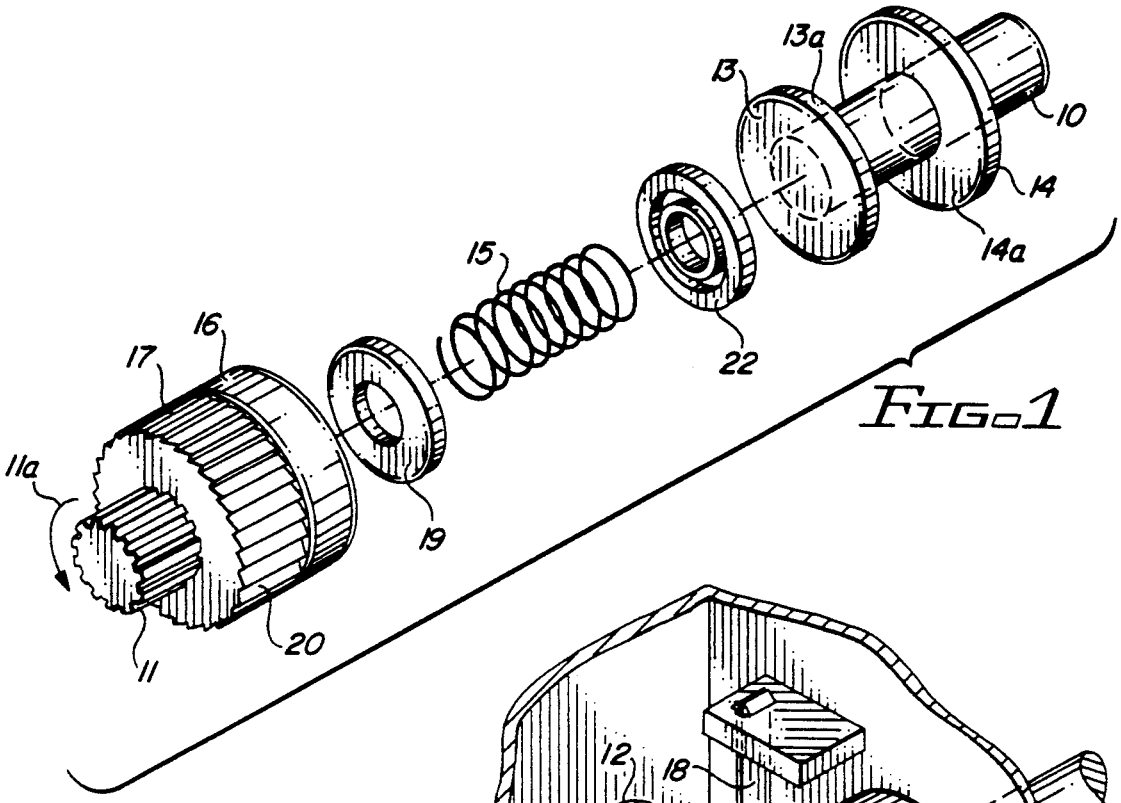
FIG. 1 is a schematic exploded view of the friction drive in accordance with the invention.

Referring to the drawings, a friction drive in accordance with the invention is adapted to translate oscillating angular movement of a drive shaft 10 into periodic one directional angular movement of a driven gear 11 or a shaft or the like (not shown). The driven gear 11 could for example drive further gears such as that shown at 12, FIG. 2, for purposes of causing a submersible cleaning device, (not shown), to perform a predetermined maneuver. The drive shaft 10 is in use caused to perform angular oscillations by an oscillator shown at 21, FIG. 3, to which it is secured.

The friction drive illustrated comprises a first friction surface 13*a* defined by a disc element 13, to which the drive shaft 10 is secured or with which it is integrally formed. The friction disc 13 is urged into contact with a second friction surface 14*a* defined by a second disc 14, by means of a compression spring 15 and the second friction disc 14 is in turn associated with a driven gear 11. The second friction disc 14 is secured to a drum formation 16 to which the driven gear 11 is secured or with which it is integrally formed so that rotational movement of the friction disc 14 causes rotational movement of the gear 11.

In an alternative arrangement (not shown), the driven gear 11 could be secured to a friction disc such as that shown at 13 which will be urged into frictional engagement with a friction surface defined by the interior blind face 20 of the drum formation 16, with the drive shaft 10 secured directly to the drum 16 or to the friction disc 13 as illustrated.

In the arrangment illustrated the friction disc 13 is into frictional engagement with the friction surfaces 14*a* by means of a compression spring 15 which terminates in washers 19 and 22.

Figure 2:
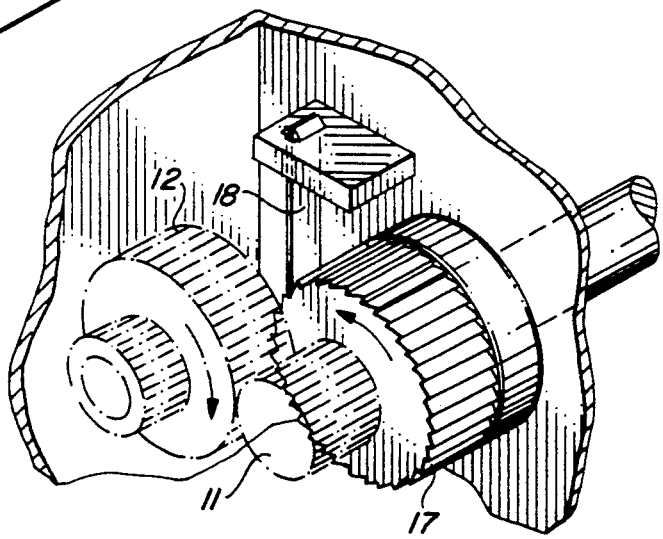
FIG. 2 is a schematic perspective view of the drive in FIG. 1, in assembled form.
Figure 3:
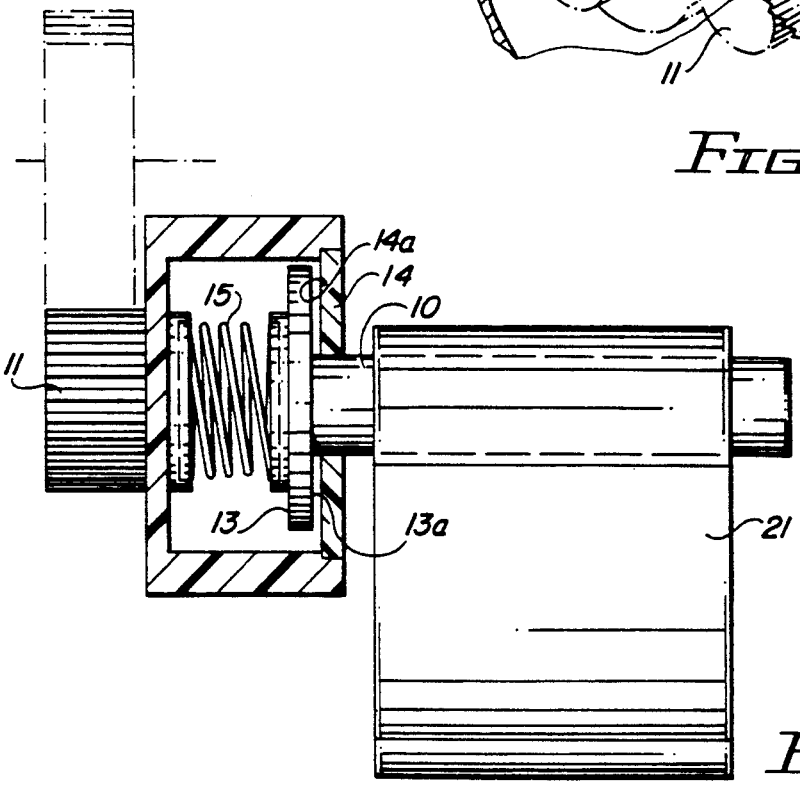
FIG. 3 is a schematic sectioned elevation of the drive in FIG. 1.

In order to limit movement of the driven gear 11 to one directional movement as shown by the arrow 11*a*, a pawl and ratchet arrangement is also provided, with teeth 17 of the ratchet being defined on the outer surface of the drum 16. With reference to FIG. 2, a pawl in the form of a resilient leaf spring 18 is affixed to a housing structure member 24 wherein the pawl 18 engages the teeth 20 to prevent reverse rotation of the drum 16 and thus the driven shaft 11.

The preferred embodiment of the invention herein described is by way of example, and the scope of the invention is not limited to the exact details of construction. Having described the invention, new and useful constructions and reasonable mechanical equivalents obvious to those skilled in the art are set forth in the appended claims.

What is claimed is:

1. A friction clutch drive useful in driving a gear for a submersible cleaning device, the friction clutch drive comprising:

an oscillator having a rotation axis;

a drive shaft affixed to the oscillator so as to be driven by the oscillator, the axis of the shaft coincident with the rotation of the oscillator;

a first friction surface affixed to an end of the drive shaft;

a drum having a second friction surface, the drum having ratchet teeth on its periphery;

a compression spring terminating in washers, the spring biased between the first and second friction surfaces;

a pawl element engaging the ratchet teeth of the drum so as to limit rotation of the drum to one direction about its axis; and a driven gear affixed to the drum and rotatable with the drum about a common axis of rotation.

2. A method for converting the oscillating motion of an oscillator in a submersible cleaner for use in driving a gear in a single rotational direction, the method comprising the steps of:

providing an oscillator rotating about an axis of rotation in a to and fro oscillating motion;

affixing a drive shaft to the oscillator for the shaft about its axis, the axis of the shaft being coincident with the axis of oscillator;

affixing a first friction surface to an end of the shaft;

providing a drum having a second friction surface within the drum, aligning the axis of the drum with the axis of the shaft, the second friction surface communicating with the first friction surface, the drum having ratchet teeth around the outside cylindrical surface;

providing a compression spring within the drum for biasing the first friction surface against the second friction surface;

engaging a pawl element with the ratchet teeth for limiting rotation of the drum to a single direction; and affixing a driven gear to an outside end of the drum, the axis of the gear aligned with the axis of the drum.

* * * * *